US007685664B2

(12) United States Patent
Stolpmann et al.

(10) Patent No.: US 7,685,664 B2
(45) Date of Patent: Mar. 30, 2010

(54) MATTRESS WITH HEEL PRESSURE RELIEF PORTION

(75) Inventors: James R. Stolpmann, Lawrenceburg, IN (US); Eric R. Meyer, Greensburg, IN (US); Gregory W. Branson, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 744 days.

(21) Appl. No.: 11/143,004

(22) Filed: Jun. 2, 2005

(65) Prior Publication Data

US 2005/0273941 A1 Dec. 15, 2005

Related U.S. Application Data

(60) Provisional application No. 60/577,122, filed on Jun. 4, 2004.

(51) Int. Cl.
*A47C 17/00* (2006.01)
*A47C 27/10* (2006.01)
*A47C 27/08* (2006.01)

(52) U.S. Cl. ..... 5/731; 5/710; 5/727; 5/706; 5/680

(58) Field of Classification Search ..... 5/710, 5/713, 706, 693, 731, 717, 727, 738, 739
See application file for complete search history.

(56) References Cited

U.S. PATENT DOCUMENTS

| | | | | |
|---|---|---|---|---|
| 2,886,834 | A | 5/1959 | Gilbertson | |
| 3,639,927 | A | 2/1972 | Munch | |
| 3,742,528 | A | 7/1973 | Munch | |
| 3,864,766 | A | 2/1975 | Prete, Jr. | |
| 4,114,230 | A | 9/1978 | MacFarland | |
| 4,127,906 | A | 12/1978 | Zur | |
| 4,169,295 | A | 10/1979 | Darling | |
| 4,306,322 | A | 12/1981 | Young et al. | |
| 4,644,597 | A | 2/1987 | Walker | |
| 4,665,573 | A * | 5/1987 | Fiore | 5/731 |
| 4,679,264 | A | 7/1987 | Mollura | |
| 4,688,283 | A | 8/1987 | Jacobson et al. | |
| 4,706,313 | A | 11/1987 | Murphy | |
| 4,724,560 | A | 2/1988 | Christie | |
| 4,766,628 | A | 8/1988 | Walker | |
| 4,788,729 | A | 12/1988 | Walker | |
| 4,803,744 | A | 2/1989 | Peck et al. | |
| 4,807,313 | A | 2/1989 | Ryder et al. | |

(Continued)

FOREIGN PATENT DOCUMENTS

| | | |
|---|---|---|
| CN | 659 180 | 1/1987 |

(Continued)

OTHER PUBLICATIONS

AccuMax™, BG Industries.

(Continued)

*Primary Examiner*—Peter M Cuomo
*Assistant Examiner*—Jonathan J Liu
(74) *Attorney, Agent, or Firm*—Kenneth C. Baran

(57) ABSTRACT

A mattress configured to support a patient including a foot section having a leg portion, a heel pressure relief portion, and a raised calf support portion positioned intermediate the leg portion and the heel pressure relief portion.

8 Claims, 9 Drawing Sheets

U.S. PATENT DOCUMENTS

| | | | | |
|---|---|---|---|---|
| 4,843,663 | A | 7/1989 | Horvat et al. | |
| 4,914,762 | A | 4/1990 | Perali et al. | |
| 4,953,247 | A | 9/1990 | Hasty | |
| 4,962,552 | A | 10/1990 | Hasty | |
| 4,982,466 | A | 1/1991 | Higgins et al. | |
| 4,995,124 | A | 2/1991 | Wridge, Jr. et al. | |
| 5,097,552 | A | 3/1992 | Viesturs | |
| 5,103,519 | A | 4/1992 | Hasty | |
| 5,142,717 | A | 9/1992 | Everard et al. | |
| 5,144,708 | A | 9/1992 | Pekar | |
| 5,243,722 | A | 9/1993 | Gusakov | |
| 5,304,271 | A | 4/1994 | Gusakov | |
| 5,323,500 | A | 6/1994 | Roe et al. | |
| 5,325,551 | A | 7/1994 | Tappel et al. | |
| 5,450,638 | A | 9/1995 | Johnson | |
| 5,469,592 | A | 11/1995 | Johnson | |
| 5,471,687 | A | 12/1995 | Vierra | |
| 5,539,942 | A | 7/1996 | Melou | |
| 5,634,224 | A | 6/1997 | Gates | |
| 5,638,565 | A | 6/1997 | Pekar | |
| 5,652,985 | A | 8/1997 | Wilkinson et al. | |
| 5,774,917 | A | 7/1998 | Liu | |
| 5,802,646 | A | 9/1998 | Stolpmann et al. | |
| 5,918,336 | A | 7/1999 | Lee et al. | |
| 6,202,239 | B1 * | 3/2001 | Ward et al. | 5/727 |
| 6,212,718 | B1 * | 4/2001 | Stolpmann et al. | 5/713 |
| 6,223,369 | B1 * | 5/2001 | Maier et al. | 5/713 |
| 6,286,167 | B1 | 9/2001 | Stolpmann | |
| 6,430,766 | B1 * | 8/2002 | Henley et al. | 5/722 |
| 6,463,610 | B1 | 10/2002 | Shulte et al. | |
| 6,584,628 | B1 | 7/2003 | Kummer et al. | |
| 7,065,816 | B2 | 6/2006 | McGettigan | |
| 2002/0116766 | A1 | 8/2002 | Stolpmann | |
| 2004/0031103 | A1 | 2/2004 | Wyatt et al. | |

FOREIGN PATENT DOCUMENTS

| | | |
|---|---|---|
| EP | 0 878 150 | 11/1998 |
| GB | 0 201 589 | 3/1922 |
| GB | 2 327 343 | 1/1999 |
| WO | 93/24088 | 12/1993 |
| WO | 99/18827 | 4/1999 |
| WO | WO02/078494 A1 | 10/2002 |

OTHER PUBLICATIONS

SAM™ Self Adjusting Mattress. Ergocheck bed system amd.
ZAAM™ zoaned adjusted mattress. Atlantis Medical, including Confidential Dealer Pricing. Aug. 1998.
KCI Atmos Air™, The Clinical Advantage.
European Search Report. European Patent Office, pp. 1 and 2, EP 05 25 3327.

* cited by examiner

MATTRESS WITH HEEL PRESSURE RELIEF PORTION

CROSS-REFERENCE TO RELATED APPLICATION

This application claims benefit to U.S. Provisional Patent Application Ser. No. 60/577,122, titled Mattress with Heel Pressure Relief Portion, to Stolpmann et al., filed Jun. 4, 2004, the disclosure of which is expressly incorporated by reference herein.

BACKGROUND AND SUMMARY OF THE INVENTION

The present invention relates generally to a mattress and, more particularly, to a mattress including a heel pressure relief portion.

Hospital beds including a deck supporting a mattress are known in the art. It is also known to provide a pressure relief portion in the mattress for supporting the heels of a patient in order to prevent skin breakdown on the back of the heels, particularly when a patient is confined to a hospital bed for an extended period of time. More particularly, the pressure relief portion is configured to reduce the interface pressure between the heels of the patient and the mattress.

In an illustrative embodiment of the present invention, a mattress configured to support a patient comprises a head section, a foot section, and a seat section positioned intermediate the head section and the foot section. The head section, the foot section, and the seat section cooperate to define a patient support surface. The foot section includes a leg portion, a heel pressure relief portion, and a raised calf support portion positioned intermediate the leg portion and the heel pressure relief portion.

Illustratively, the patient support surface within the calf support portion extends above the patient support surface within the leg portion, and the patient support surface within the calf support portion extends above the patient support surface within the heel pressure relief portion.

Illustratively, the heel pressure relief portion includes a foam layer having a first stiffness, and the calf support portion includes a foam layer having a second stiffness, the first stiffness being less than the second stiffness.

Further illustratively, a plurality of support bladders extend longitudinally from the head section to the foot section. An upper foam layer is positioned above the air bladders and includes a plurality of longitudinally extending downwardly facing arcuate recesses configured to receive an upper portion of the air bladders. The arcuate recesses illustratively extend from the head section through the seat section and stop proximate the calf support portion of the foot section. Since the arcuate recesses do not extend within the calf support portion, the upper foam layer is positioned vertically higher within the calf support portion than in the seat section.

In a further illustrative embodiment of the present invention, a mattress configured to support a patient comprises a plurality of longitudinally extending support bladders, and an upper foam layer supported above the support bladders. The upper foam layer includes a first portion, and a second portion positioned proximate the first portion. An upper surface is defined by the first portion and the second portion. The upper surface within the second portion includes an apex. A plurality of longitudinally extending, downwardly facing arcuate recesses extend within the first portion and are configured to receive an upper portion of the support bladders. The upper surface lowers relative to the support bladders as the upper surface extends from the apex in a direction from the second portion to the first portion.

Illustratively, the upper foam layer further includes a heel pressure relief portion, wherein the first portion defines a leg portion, and the second portion defines a raised calf support portion positioned intermediate the leg portion and the heel pressure relief portion. Further illustratively, the upper foam layer also includes a head section and a seat section, wherein the leg portion, the raised calf support portion, and the heel pressure relief portion cooperate to define a foot section, the seat section being positioned intermediate the head section and the foot section.

In a further illustrative embodiment of the present invention, a mattress comprises an upper foam layer including an upper surface, a plurality of longitudinally extending support bladders positioned below the upper foam layer, and a lower foam layer positioned below the support bladders. Illustratively, the stiffness of the lower foam layer is greater than the stiffness of the upper foam layer.

Illustratively, an outer cover encloses the upper foam layer, the support bladders, and the lower foam layer. Further illustratively, the upper foam layer includes a first portion, a second portion positioned proximate the first portion, and an upper surface defined by the first portion and the second portion. The upper surface within the second portion includes an apex. A plurality of longitudinally extending, downwardly facing arcuate recesses extend within the first portion and are configured to receive an upper portion of the support bladders. The upper surface lowers relative to the support bladders as the upper surface extends from the apex in a direction from the second portion to the first portion.

Illustratively, the upper foam layer further includes a heel pressure relief portion. The first portion defines a leg portion, and the second portion defines a raised calf support portion positioned intermediate the leg portion and the heel pressure relief portion. Illustratively, the upper foam layer also includes a head section and a seat section, wherein the leg portion, the raised calf support portion, and the heel pressure relief portion cooperate to define a foot section, the seat section being positioned intermediate the head section and the foot section.

Further illustratively, a plurality of magnets are supported below the lower foam layer and one configured to releasably couple with a deck assembly supporting the mattress.

Additional features and advantages of the present invention will become apparent to those skilled in the art upon consideration of the following detailed description of the presently perceived best mode of carrying out the invention.

BRIEF DESCRIPTION OF THE DRAWINGS

The detailed description of the drawings particularly refers to the accompanying figures in which.

DETAILED DESCRIPTION OF THE DRAWINGS

Figures 1, 2:
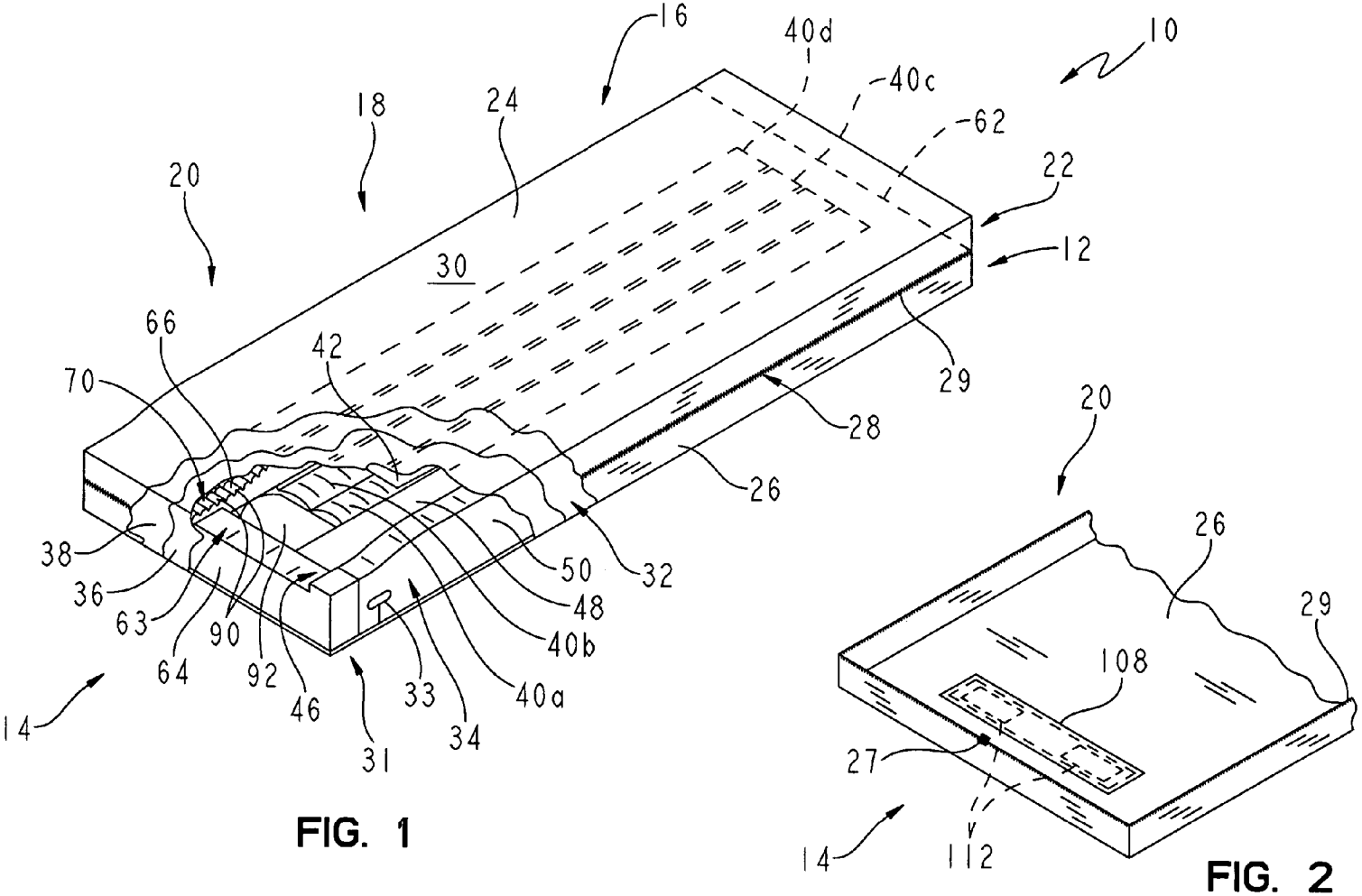
FIG. 1 is a perspective view, with a partial cut-away, of the mattress of the present invention.
FIG. 2 is a detailed top perspective view of the bottom cover portion of the mattress of FIG. 1 at the foot end thereof, illustrating the magnet receiving pocket, and coupling magnets supported therein.
Figure 3:
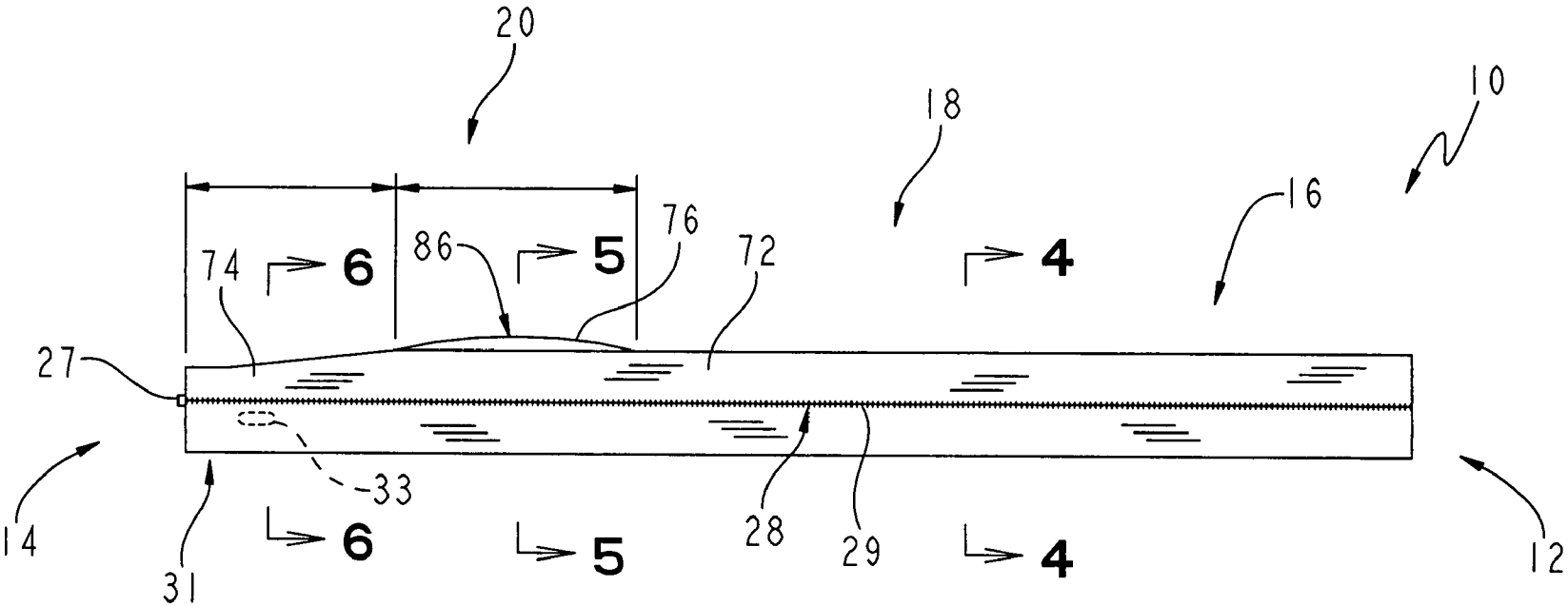
FIG. 3 is a side elevational view of the mattress of FIG. 1.

Referring initially to FIGS. 1-3, a mattress 10 in accordance with an illustrative embodiment of the present invention extends longitudinally between a head end 12 and a foot end 14. In the following detailed description, the terminology "head end" will refer to a component of the mattress 10 which is positioned closer to the head end 12 than the foot end 14 of the mattress 10, and conversely, the terminology "foot end" will refer to a component of the mattress 10 which is positioned closer to the foot end 14 than the head end 12 of the mattress 10. Extending in a direction from the head end 12 to the foot end 14, the mattress 10 includes a head section 16, a seat section 18 and a foot section 20.

The mattress 10 includes an outer cover 22 having a top cover portion 24 and a bottom cover portion 26 connected to the top cover portion 24 by a conventional zipper 28 as shown in FIG. 1. Top cover portion 24 includes an upwardly facing patient support surface 30 configured to support a patient. Top cover portion 24 cooperates with bottom cover portion 26 to provide the outer cover 22 with an interior region or chamber 32. The top cover portion 24 is illustratively formed from a conventional ticking material such as a stretchable polyurethane which is resistant to fluids and chemical stains. The bottom cover portion 26 is illustratively formed from a polyurethane coated twill material for enhanced wear resistance and to protect other components of the mattress 10 from contamination. In one illustrative embodiment, pleats (not shown) are provided in the top cover portion 24 proximate the head end 12, the foot end 14, and the center thereof, to provide a loose, yet not excessively baggy, fit.

The zipper 28 illustratively includes a pull 27 operably coupled to a track 29, which begins at a location proximate the center of foot end 14 of the mattress 10 (FIGS. 2 and 3) to facilitate access to a fill port access opening 33 (FIG. 1). More particularly, the pull 27 may be moved along the track 29 around the corner 31 such that the top cover portion 24 may be separated from the bottom cover portion 26, thereby exposing the corner 31 and the fill port access opening 33. As such, easy access is provided to the opening 33 without requiring substantial removal of the outer cover 22.

The mattress 10 further includes a core structure 34, a fire barrier 36 and an inner shear liner 38, each of which are received within the interior region 32 of outer cover 22. The shear liner 38 is illustratively formed from a material having a low coefficient of friction so that the mattress outer cover 22 can slide relative to other components of the mattress 10. In the illustrative embodiment, the shear liner 38 is formed from a polyurethane material. The fire barrier 36 may be made of a conventional fire-resistant material, such as a fiberglass knit.

The core structure 34 includes a plurality of longitudinally extending, transversely spaced-apart support bladders 40. The support bladders 40 are illustratively cylindrically-shaped and are received within an outer pouch or cover 42 (FIGS. 4, 5, 7 and 8). While four support bladders 40*a*, 40*b*, 40*c*, and 40*d* are shown in the illustrative embodiment, it should be appreciated that the number of support bladders 40 may be varied. First and second side bolsters 44 and 46 extend longitudinally and substantially parallel to the outer support bladders 40*a* and 40*d*, respectively. Each of the side bolsters 44 and 46 include longitudinally extending inner and outer foam portions 48 and 50. With reference to FIGS. 5 and 6, each inner foam portion 48 includes an arcuate sidewall 52 having a notch or opening 54 formed therein in order to conform with the shape of the outer cover 42 adjacent respective support bladder 40*a*, 40*d*. Each inner foam portion 48 includes a substantially planar outer wall 56 which is affixed to a planar inner wall 58 of the outer foam portion 50 in a conventional manner, illustratively through an adhesive. Each inner foam portion 48 has a stiffness less than that of the corresponding outer foam portion 50. For example, the inner foam portion 48 may have an indention load deflection (ILD) of approximately 15 pounds, while the outer foam portion 50 may have an ILD of approximately 40 pounds. ILD is a well-known measurement generally defined as the load necessary to compress a 4 inch thick piece of foam 25%. By the inner foam portion 48 having a stiffness less than the outer foam portion 50, a patient positioned proximate the side of the mattress 10 tends to be directed inwardly toward a longitudinal center axis 60 of the mattress 10.

Referring again to FIGS. 1, 7, and 8, a head end bolster 62 and a foot end bolster 64 are positioned adjacent the head end 12 and the foot end 14, respectively, of the mattress 10 and are coupled to the first and second side bolsters 44 and 46, illustratively through conventional means such as an adhesive. The end bolsters 62 and 64 are relatively stiff, illustratively having an ILD of approximately 40 pounds. The foot end bolster 64 includes a downwardly extending notch 63 defining a support surface 65 configured to receive an upper foam layer 66. As such, the upper foam layer 66 can extend over the foot end bolster 64 to the foot end 14 of the mattress 10.

The support bladders 40 are positioned intermediate an upper foam layer 66 and a lower foam layer 68. Both the upper foam layer 66 and the lower foam layer 68 are illustratively formed of a polyurethane foam material. Turning now to FIGS. 3-9, the upper foam layer 66 extends from the head end 12 to the foot end 14 of the mattress 10 and thereby defines portions of the head section 16, the seat section 18, and the foot section 20. The upper foam layer 66 includes an upper or patient support surface 70 which is substantially planar within the head section 16 and the seat section 18 of the mattress 10. As further detailed below, the softer upper foam layer 66 extends above the stiffer foot end bolster 62, such that the patient support surface 70 extends to the foot end 14 of the mattress 10. Within the foot section 20, the upper foam layer 66 cooperates with the support bladders 40 to define a leg portion 72 and a raised calf support portion 76 which is positioned intermediate the leg portion 72 and a heel pressure relief portion 74. The patient support surface 70 within the calf support portion 76 extends above the patient support surface 70 within the leg portion 72 and the heel pressure relief portion 74. Illustratively, the patient support surface 70 rises in elevation due to its cooperation with the support bladders 40. Illustratively, the lower foam layer 68 has a ILD of approximately 40 pounds, while the upper foam layer 66 within the head section 16, the seat section 18, and the heel relief portion 74 has an ILD of approximately 15 pounds. To assist in supporting the calves of a patient, the upper foam layer 66 within the calf support portion 76 illustratively has an ILD of between 31 and 39 pounds.

Figure 4:
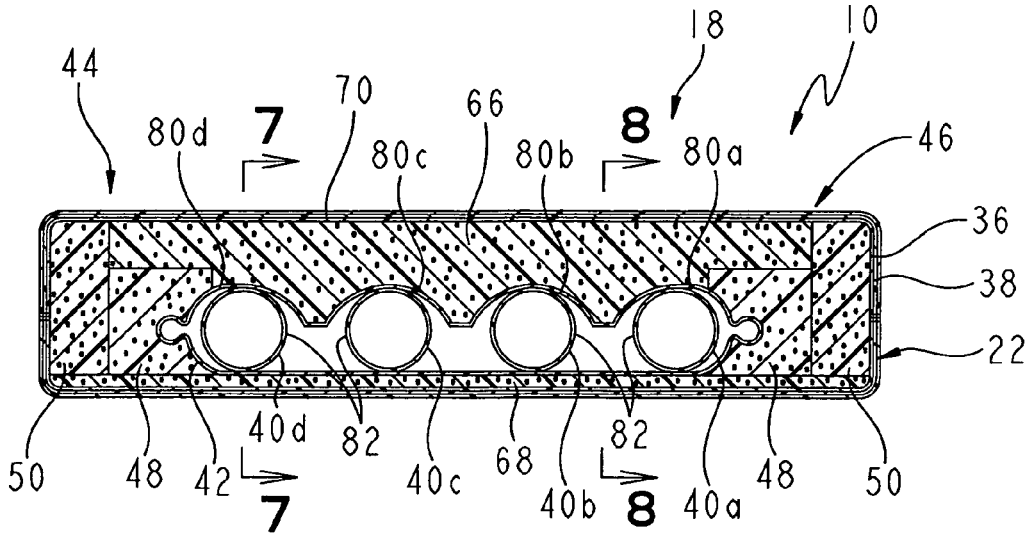
FIG. 4 is a cross-sectional view taken along line 4-4 of FIG. 3.
Figure 5:
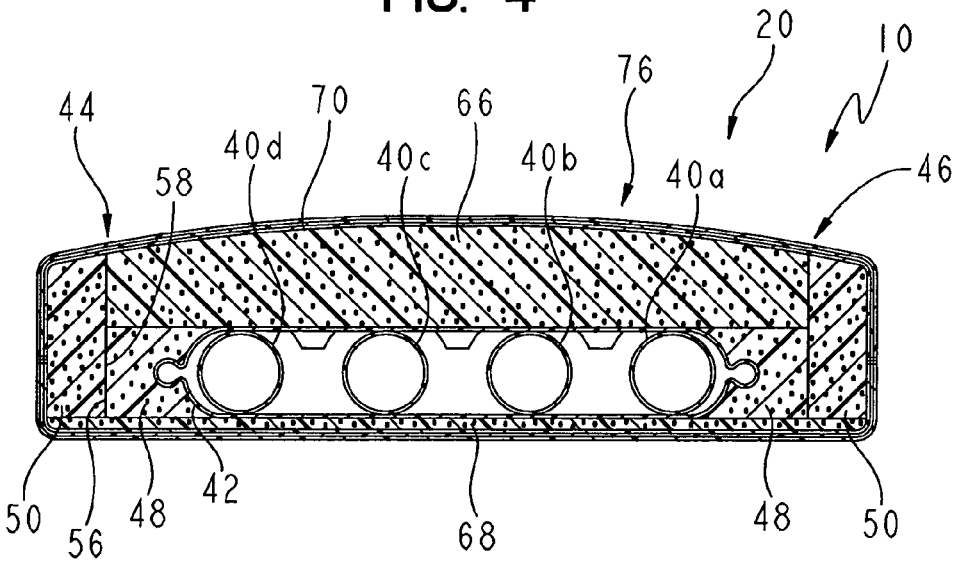
FIG. 5 is a cross-sectional view taken along line 5-5 of FIG. 3.
Figure 6:
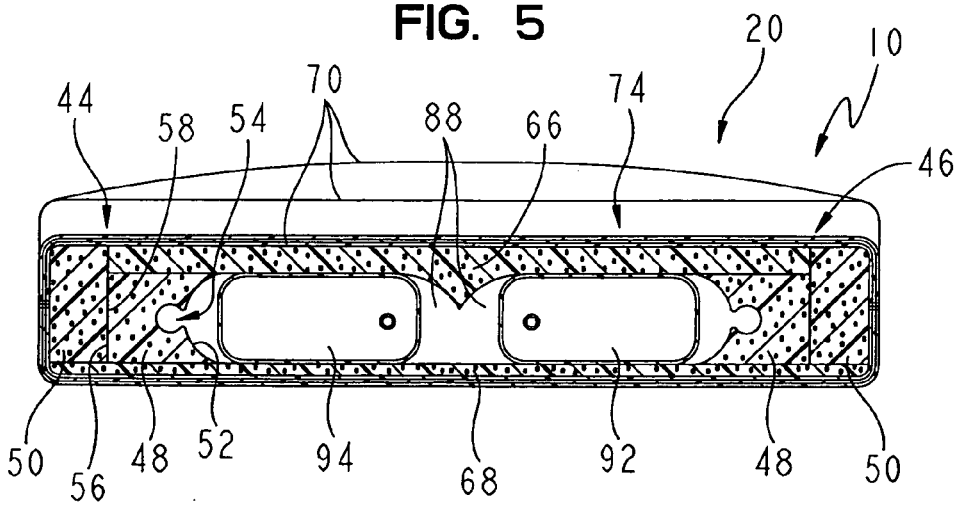
FIG. 6 is a cross-sectional view taken along line 6-6 of FIG. 3.
Figure 7:
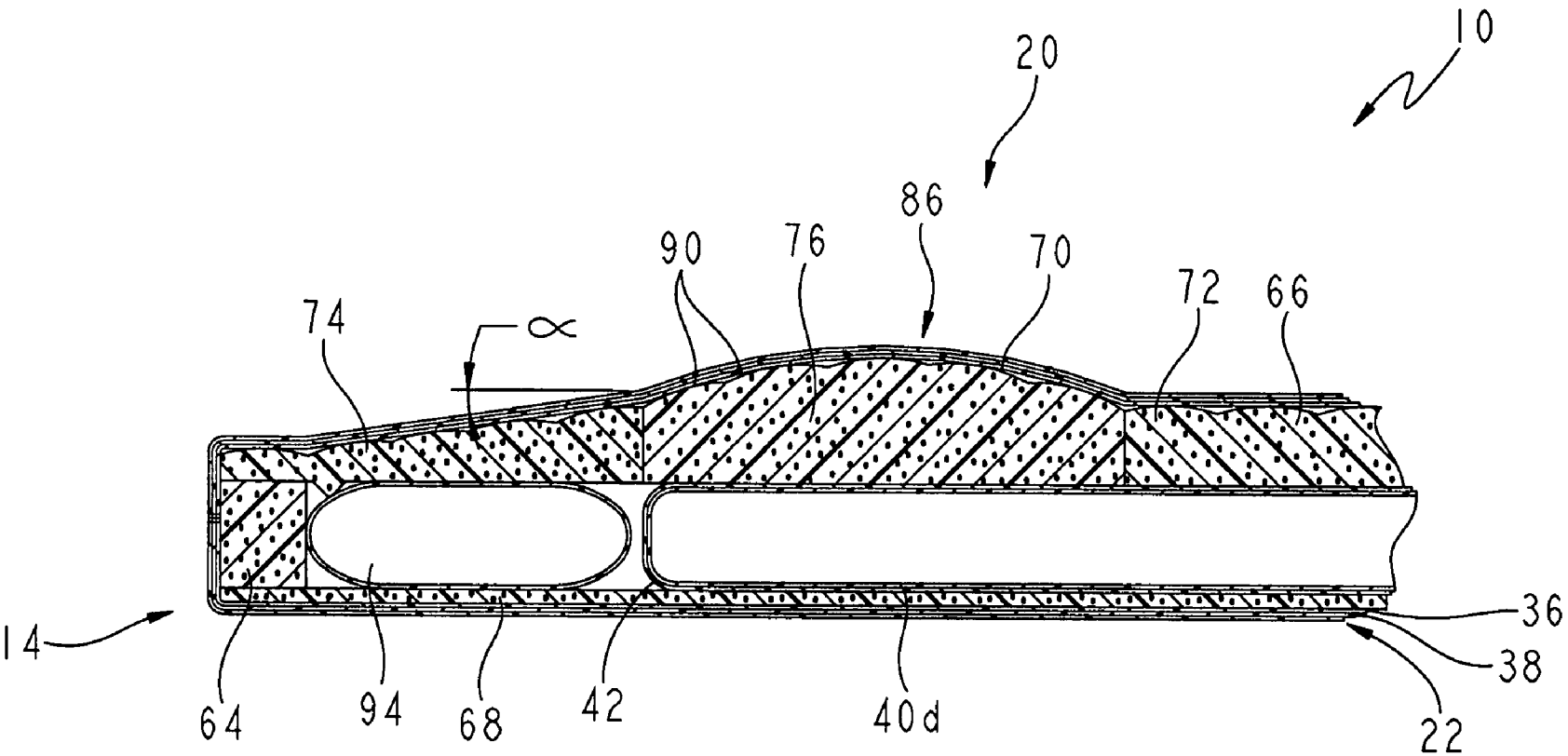
FIG. 7 is a cross-sectional view taken along line 7-7 of FIG. 4.
Figure 8:
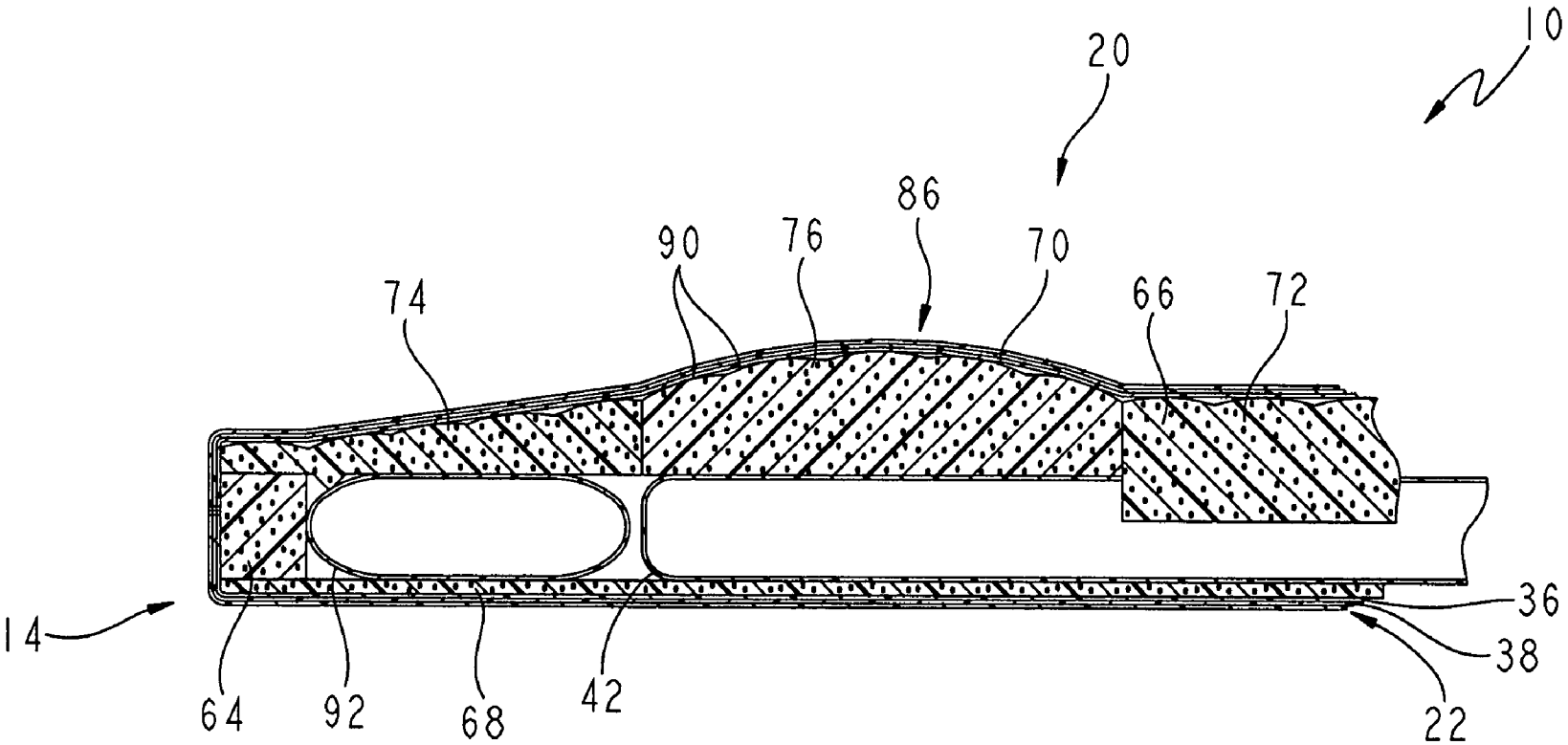
FIG. 8 is a cross-sectional view taken along line 8-8 of FIG. 4.
Figure 9:
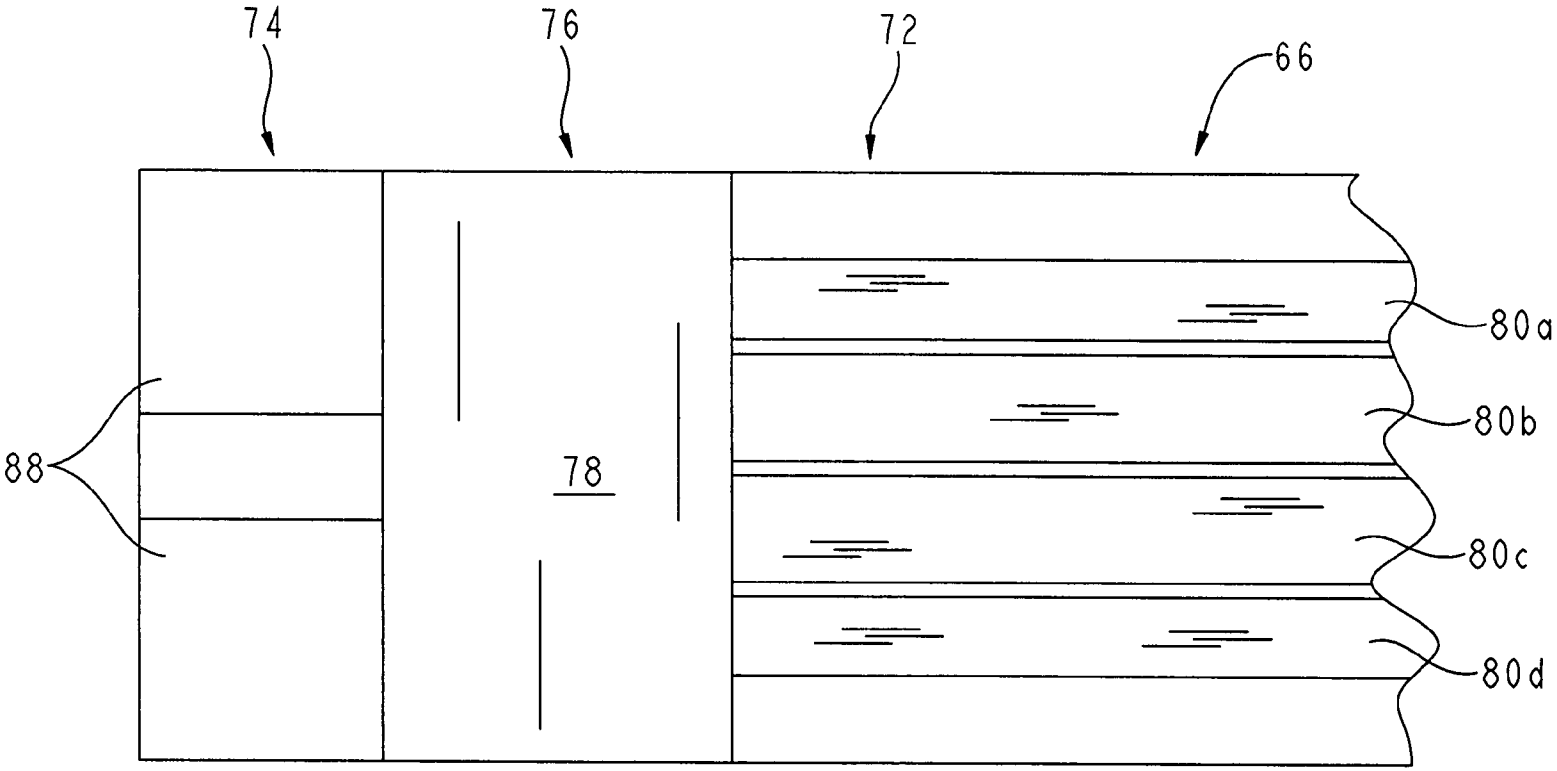
FIG. 9 is a bottom plan view of the upper foam layer of the mattress of FIG. 1.

With further reference to FIGS. 4, 5, and 7-9, the lower surface 78 of the upper foam layer 66 includes a plurality of arcuate cut-outs or recesses 80 configured to cooperate with and receive an upper portion 82 of each support bladder 40 (FIG. 4). The arcuate recesses 80 illustratively extend only within the head section 16 and the seat section 18 of the mattress 10. The lower surface 78 of the upper foam layer 66 within the calf support portion 76 of the foot section 20 is substantially planar and, as such, rests on the top of the upper portion 82 of each support bladder 40. As such, the upper surface 70 of the upper foam layer 66 within the portion of the upper foam layer 66 including the recesses 80 is positioned lower than the portion of the upper foam layer 66 not including the recesses 80. Moreover, the lower planar surface 78 elevates the upper surface 70 to a vertically higher position within the raised calf support portion 76. The upper surface 70 peaks or reaches a maximum elevation at an apex 86 within the raised calf support portion 76. As the patient support surface 70 extends toward the foot end from the apex, the surface is angled downwardly by an angle $\alpha$ (FIG. 7), illustratively equal to approximately 8° from horizontal. The downward angle $\alpha$ is illustratively provided by changing the thickness of the upper foam layer 66 within the heel pressure relief portion 74, either alone or in combination with providing accumulator cut-outs or recesses 88 (FIGS. 8 and 9).

As shown in FIGS. 1, 7 and 8, the upper foam layer 66 may include a plurality of convolutions 90 which have longitudinally extending slits (not shown) extending therethrough, to assist in reducing patient shear and to facilitate articulation of the mattress 10. Additional details of the convolutions 90 and cooperating slits are provided in U.S. Pat. No. 4,862,538, the disclosure of which is expressly incorporated herein by reference.

With reference to FIGS. 1, 6-8, and 10, accumulator recesses 88 are provided for accumulator bladders 92 and 94. The first accumulator bladder 92 is in fluid communication with second and fourth support bladders 40*b* and 40*d* through tubes 96*a* and 96*b*. Likewise, the second accumulator bladder 94 is in fluid communication with first and third support bladders 40*a* and 40*c* through tubes 98*a* and 98*b*. Fluid ports 100*a* and 100*b* are in fluid communication with accumulator bladders 92 and 94, respectively. As illustrated, the fluid ports 100*a* and 100*b* are sealed by conventional caps or plugs 102*a* and 102*b*, thereby defining a closed loop system. The accumulator bladders 92 and 94 cooperate with the support bladders 40 in order to provide self-adjusting technology (SAT) air system. Moreover, the mattress 10 exchanges air between the support bladders 40 and the accumulator bladders 92 and 94 in response to patient weight. Such technology is known in the art, and additional details are provided in U.S. Pat. No. 5,652,985, the disclosure of which is expressly incorporated by reference herein.

Figure 11:
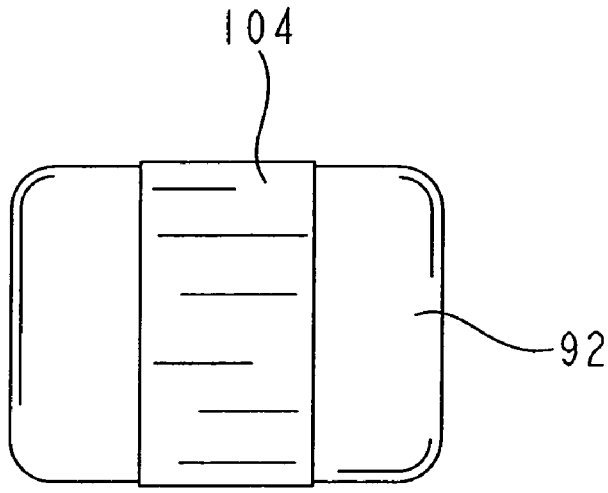
FIG. 11 is a side elevational view of an accumulator bladder of the present invention in a filled state.
Figure 12:
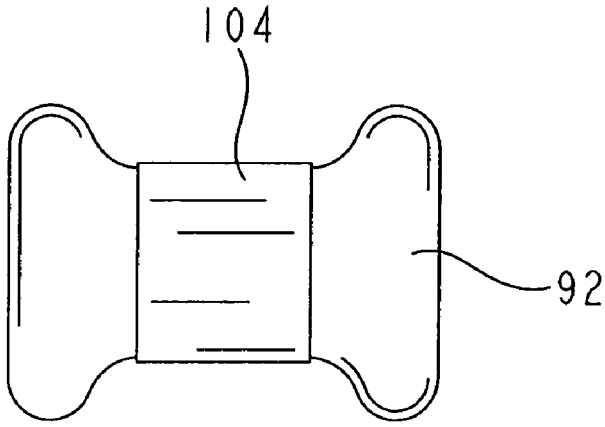
FIG. 12 is a view similar to that of FIG. 11, illustrating the accumulator bladder in a deflated state.

An elastic band 104 extends around each accumulator bladder 92 and 94 at a generally central location. When a patient is supported by the mattress 10, air is forced into the accumulator bladders 92 and 94 from the bladders 40. More particularly, air flows from the bladders 40 through the tubes 96 and 98 and into the accumulator bladders 92 and 94 until an equilibrium condition is achieved. This forces the elastic bands 104 to expand with the accumulator bladders 92 and 94, as shown in FIG. 11.

Figure 10:
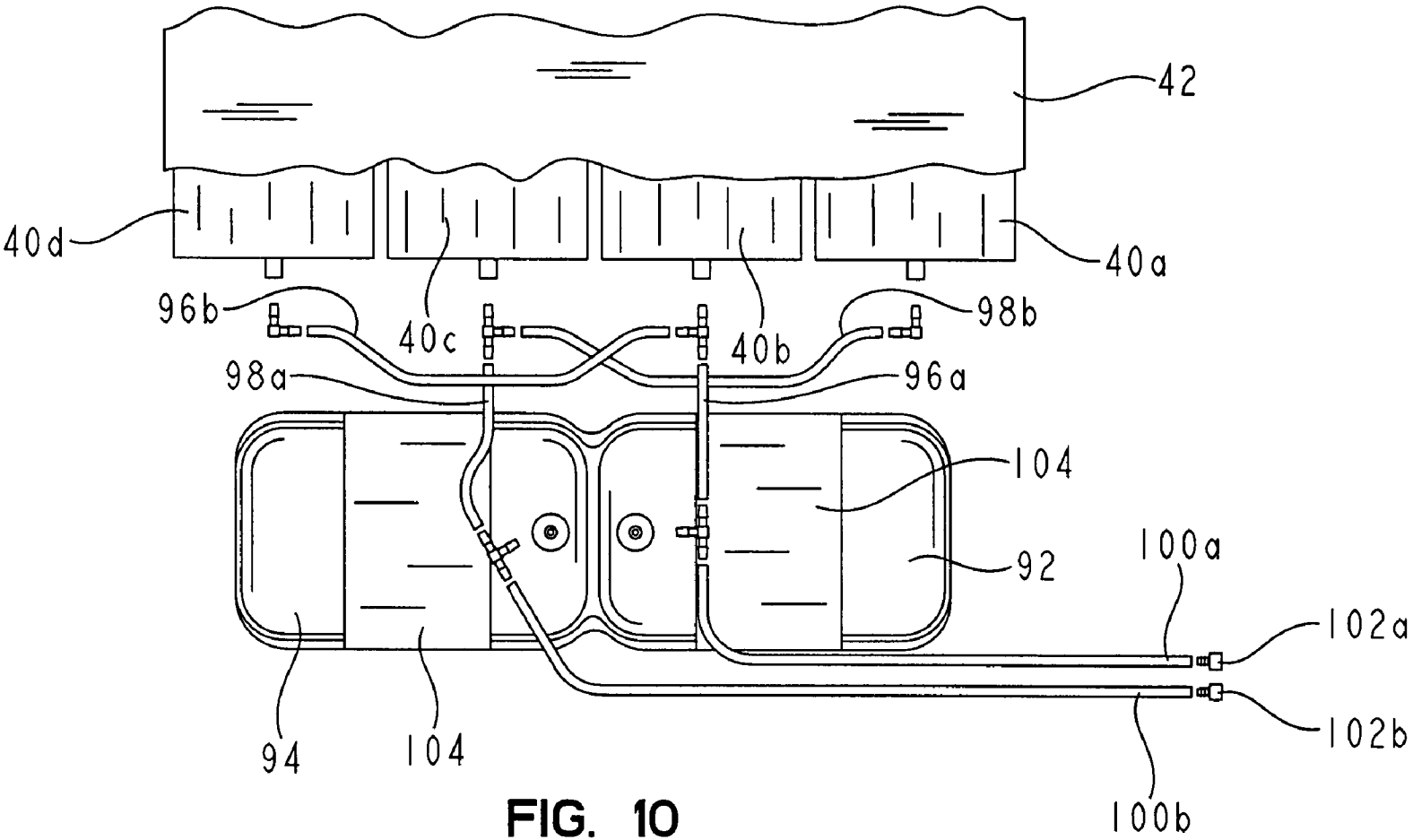
FIG. 10 is a detailed, partially exploded, top plan view illustrating the accumulator bladders, the support bladders, and the fluid connections therebetween.

As stated above, the air system of mattress 10 is a closed loop system with no components being vented to atmosphere. Accordingly, when the patient exits the bed supporting the mattress 10, the elastic bands 104 contract, as shown in FIG. 10, to force air out of the accumulator bladders 92 and 94, through tubes 96 and 98, and into bladders 40.

Figure 13:
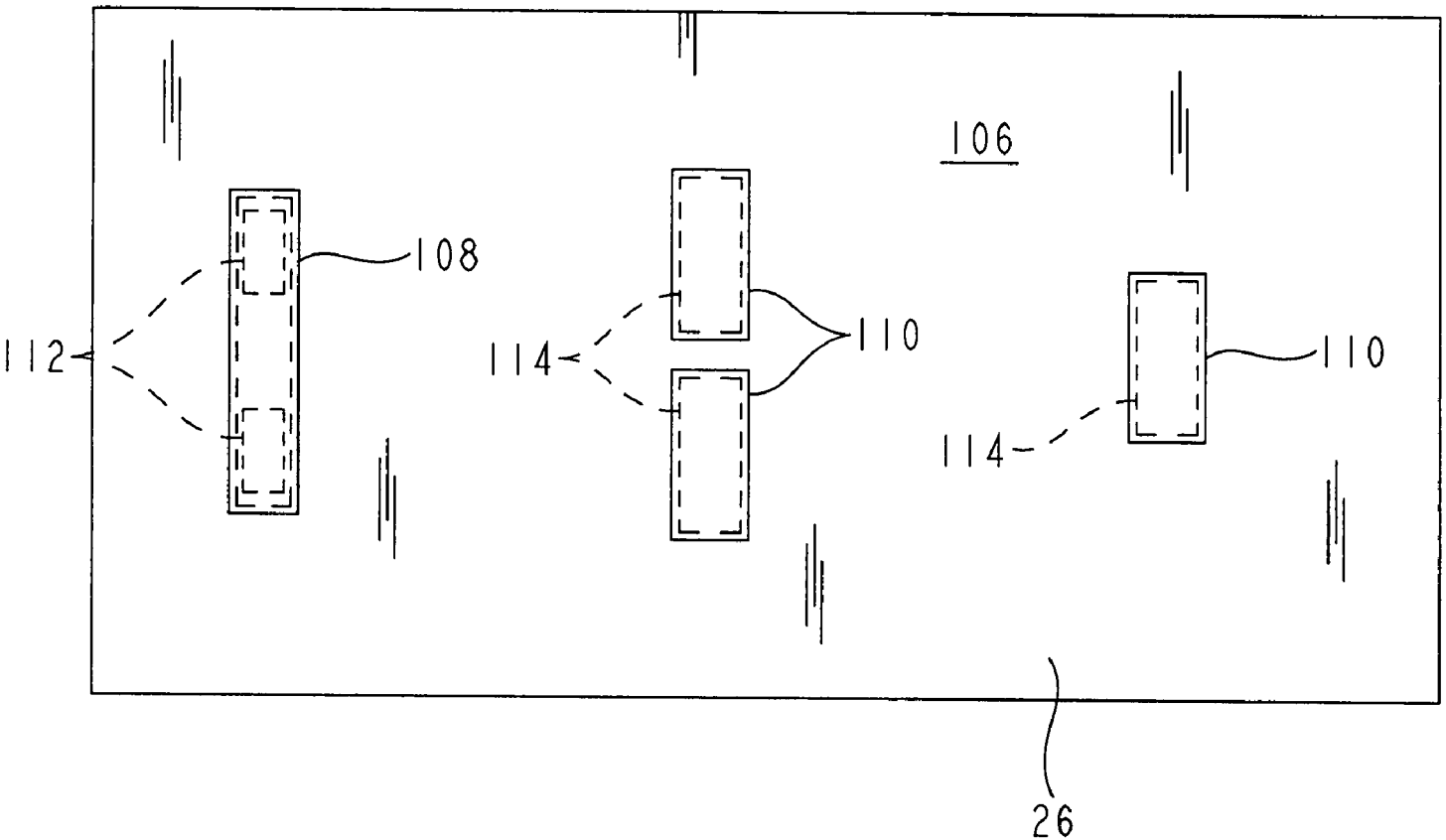
FIG. 13 is a bottom plan view of the mattress of FIG. 1, illustrating the pockets for receiving the force directing plates and the coupling magnets.

Turning now to FIGS. 2 and 13, the bottom cover 26 includes a lower surface 106 supporting a plurality of pockets 108, 110. A magnet receiving pocket 108 includes a plurality of magnets 112 which are configured to couple to a conventional metal hospital deck (not shown). A plurality of force directing pockets 110 are provided to receive force directing plates 114 which are configured to receive downward forces as received from the lower foam layer 68 and to direct these forces to a conventional patient position monitors (not shown) supported by the hospital bed deck. Illustratively, the force direction plates 114 are formed of a thermoplastic material.

Although the invention has been described in detail with reference to certain preferred embodiments, variations and modifications exist within the spirit and scope of the invention as described and defined in the following claims.

The invention claimed is:

1. A mattress configured to support a patient, the mattress comprising:

a head section; a foot section; a seat section positioned intermediate the head section and the foot section, the head section, the foot section, and the seat section cooperating to define a patient support surface, the foot section including a leg portion, a heel pressure relief portion, and a raised calf support portion positioned intermediate the leg portion and the heel pressure relief portion;

a plurality of support bladders extending longitudinally from the head section to the foot section; and an upper foam layer positioned above the support bladders, the upper foam layer including longitudinally extending, downwardly facing arcuate recesses configured to receive an upper portion of the support bladders;

wherein the arcuate recesses do not extend within the calf support portion, such that the upper foam layer is positioned vertically higher within the calf support portion than in the seat section.

2. A mattress configured to support a patient, the mattress comprising:

a plurality of longitudinally extending support bladders;

an upper foam layer supported above the support bladders and including: a heel pressure relief portion, a first portion, a second portion having a substantially planar lower surface, the second portion being positioned proximate the first portion, an upper surface defined by the first portion and the second portion, the first portion defining a leg portion, the second portion defining a raised calf support portion positioned intermediate the leg portion and the heel pressure relief portion, the upper surface within the second portion including an apex, and a plurality of longitudinally extending, downwardly facing arcuate recesses extending within the first portion and configured to receive an upper portion of the support bladders, the upper surface lowering relative to the support bladders as the upper surface extends from the apex in a direction from the second portion to the first portion; and a lower foam layer positioned below the upper foam layer, the lower foam layer having a stiffness greater than a stiffness of at least a portion of the upper foam layer.

3. A mattress comprising: an upper foam layer including a heel pressure relief portion, a first portion, a second portion positioned proximate the first portion, an upper surface defined by the first portion and the second portion, the first portion defining a leg portion, and the second portion defining a raised calf support portion positioned intermediate the leg portion and the heel pressure relief portion, the upper surface within the second portion including an apex, a plurality of longitudinally extending support bladders positioned below the upper foam layer, a plurality of longitudinally extending, downwardly facing arcuate recesses extending within the first portion and configured to receive an upper portion of the support bladders, the upper surface lowering relative to the support bladders as the upper surface extends from the apex in a direction from the second portion to the first portion;

a lower foam layer positioned below the support bladders and configured to direct forces applied to the upper surface to a deck assembly supporting the mattress; and wherein a stiffness of the lower foam layer is greater than a stiffness of at least a portion of the upper foam layer.

4. The mattress of claim 3, wherein the upper foam layer further includes: a head section; and a seat section; wherein the leg portion, the raised calf support portion, and the heel pressure relief portion cooperate to define a foot section, the seat section being positioned intermediate the head section and the foot section.

5. The mattress of claim 3, wherein the foam layer in the first portion has a first stiffness, and the foam layer in the second portion has a second stiffness, the first stiffness being less than the second stiffness.

6. The mattress of claim 3, further comprising at least one accumulator bladder in fluid communication with the support bladders and configured to maintain a constant internal pressure in the support bladders by adjusting fluid supplied to the support bladders in response to changing force applied to the upper surface.

7. The mattress of claim 3, further comprising a plurality of magnets supported below the lower foam layer.

8. The mattress of claim 7, further comprising an outer cover enclosing the upper foam layer, the support bladders, and the lower foam layer, the outer cover including a pocket configured to receive the plurality of magnets.

* * * * *